United States Patent [19]

Sthare et al.

[11] 3,940,247

[45] Feb. 24, 1976

[54] DYE MIGRATION CONTROL WITH AMINE SALT OF POLY(VINYL METHYL ETHER/MALEIC ACID)

[75] Inventors: Derwin Sthare, Yorbalinda, Calif.; Richard F. Chambers, Pompton Lakes, N.J.

[73] Assignee: GAF Corporation, New York, N.Y.

[22] Filed: Dec. 3, 1973

[21] Appl. No.: 421,113

[52] U.S. Cl. ..... 8/172 R; 8/173; 8/85 R; 8/92

[51] Int. Cl.[2] ..... D06P 5/06

[58] Field of Search ..... 8/173, 172, 85, 92, 87

[56] References Cited

UNITED STATES PATENTS 1,976,679 10/1934 Fikentscher et al. ..... 8/34 X

FOREIGN PATENTS OR APPLICATIONS 871,193 6/1961 United Kingdom ..... 8/85

*Primary Examiner*—Lewis T. Jacobs

*Attorney, Agent, or Firm*—Walter C. Kehm; Joshua J. Ward

[57] ABSTRACT

In the Thermosol and like processes in which a dye-impregnated textile material is dried prior to fixation, uncontrolled migration of the dye to the surface of the material during the drying operation is obviated by the incorporation of an antimigration additive in the aqueous dye bath liquid, said additive being an amine salt of poly(vinyl methyl ether/maleic acid). The parent poly(vinyl methyl ether/maleic anhydride) from which the said poly(vinyl methyl ether/maleic acid) is prepared by hydrolysis has a specific viscosity of about 0.75 to about 4.5, preferably about 1.0 to 3.5, more preferably from about 2.0 to about 3.5, measured at a concentration of 1 gram of said parent polymer per 100 ml. of methylethyl ketone at 25°C. The additive, employed within the general range of from about 0.05% to about 0.50% by weight based on the total weight of the dye bath, serves to enhance the uniformity of the dyeing operation and the color properties of the dyed textile material.

11 Claims, No Drawings

DYE MIGRATION CONTROL WITH AMINE SALT OF POLY(VINYL METHYL ETHER/MALEIC ACID)

BACKGROUND OF THE INVENTION

1. Field of the Invention

This invention relates to the dyeing of textile materials. More particularly, it relates to a dye bath composition and to a dyeing process in which uncontrolled migration of the dye to the material surface during drying prior to fixation is minimized.

Description of the Prior Art

In commercial dyeing operations in which a textile material is impregnated with a dye by padding with an aqueous dye bath liquid, as in the conventional Thermosol process, the dye-impregnated material is commonly dried, e.g., by heating, prior to fixation of the dye. It is well known that the dye particles tend to migrate to the surface of the material during the drying operation and that such migration tends to be of an uncontrolled and random nature. Such uncontrolled migration, however, leads to an uneven dyeing, detracting from the appearance and value of the dyed textile material. As a result, various additives, including natural gums, sodium alginate and a variety of synthetic antimigrants have been proposed in order to reduce such uncontrolled migration. Many of the materials thus proposed in the literature were described also with respect to thickening characteristics, the terms "thickeners" and "antimigrants" commonly being employed synonymously. While many materials thus proposed as antimigrants also tend to find application in other systems as thickeners, the more persuasive teachings available suggest that the viscosity of the dye bath per se does not have any significant effect with respect to the uncontrolled dye migration problem discussed above.

While various materials have thus been proposed as antimigration additives, no such materials have found widespread acceptance because of the relatively high incremental costs associated with the use of such antimigrants, undesirable side effects that often occur as a result of the presence of particular antimigrants in specific aqueous dye bath liquor systems or a combination of these or like factors disadvantageous in the overall dyeing operation. There exists in the art, therefore, a need and a desire for less expensive, more technically efficient antimigrants having an enhanced compatibility with aqueous dye bath liquid systems for the dyeing of textile materials.

It is an object of the present invention, therefore, to provide an improved aqueous dye bath liquid capable of minimizing undesired dye migration.

It is another object of the invention to provide an improved dyeing process in which migration of the dye during drying prior to fixation is minimized.

It is a further object of the invention to provide an improved dye bath liquid having a desirable combination of effective dye migration prevention and minimal incremental cost.

With these and other objects in mind, the invention is hereinafter disclosed in detail, the novel features thereof being particularly pointed out in the appended claims.

SUMMARY OF THE INVENTION

Dyed textile material of enhanced quality and appearance is conveniently obtained by minimizing uncontrolled dye migration to the surface of the material during drying prior to dye fixation by the incorporation of an amine salt of poly(vinyl methyl ether/maleic acid) in the aqueous dye bath liquid. The amine salt is incorporated in the aqueous dye bath liquid in small amounts within the general range of from about 0.05% to about 0.50% by weight, based on the total weight of said dye bath. By padding an aqueous dye bath liquid containing the indicated antimigration agent therein onto the textile material being treated, it is thereafter possible to dry the dyeimpregnated material prior to fixation without appreciable uncontrolled dye migration during the drying operation, thus preserving a greater uniformity of dyeing and permitting the production of the enhanced quality of product referred to above.

DETAILED DESCRIPTION OF THE INVENTION

The present invention applies to dyeing operations of the type represented by the conventional Thermosol process in which a dye is padded onto the fabric, achieving penetration into the textile fiber itself, followed by a drying of the dyeimpregnated textile material and a subsequent curing or fixation of the dye as by a heat treatment operation. While numerous proposals have been made for controlling the well known migration of the dye particles to the surface of the material during the drying step, the present invention is particularly advantageous in that the improved antimigration result achieved by carrying out the dyeing operation by the use of the novel dye bath liquid herein disclosed and claimed is of an economical nature and may readily be applied to a wide variety of dyeing operations, involving a variety of different textile materials and types of dyes. This combination of effective antimigration effect, economy and flexibility of application represents a significant advance in the efforts in the art to overcome the adverse effects resulting from uncontrolled migration of dyes during essential portions of the overall dyeing operations as conveniently carried out in commercial textile dyeing applications.

The novel dye bath liquid and the dyeing process that represent differing aspects of the present invention can readily be applied in the dyeing of the various textile materials commonly dyed by the conventional Thermosol process approach. Such materials include cotton fibers, polyester fibers, polyester-cotton blends, and the like, that are thus dyed in very large quantities in commercial operations. The invention is not limited to such fibers, however, but may also be readily applied to acrylic fibers, wool and the like. It might be noted, in this regard, that the Thermosol process is commonly employed for such dyeing purposes since it is readily adapted for continuous processing involving padding, drying and curing by heat treatment or chemical means. Operations in which the material being treated is cooked or otherwise treated in the dye bath for dye fixation purposes prior to drying, on the other hand, are more commonly of a batch type operation.

One of the advantageous features of the present invention is its general application with respect to a variety of dyes, as opposed to an antimigrant approach that may only apply with respect to a particular type of dye or a specific dye product. Thus, the present invention may be practiced in dyeing operations involving such dyes as direct dyes, vat dyes, reactive dyes, disperse dyes, acid dyes and other such dyes that are of utility, from a practical viewpoint, for textile dyeing purposes. It will be appreciated that a vast number of dyes of the various, commercially useful types are available in the art, such dyes being well known in the art, described in numerous patents and further designated by a systematic Color Index number arrangement as is well known in the art. As the invention is not limited to any specific type of dye or to any particular dye, no further descriptive matter is deemed necessary with respect to the dyes per se, apart from the general references to such dyes herein with respect to the improvements in the aqueous dye bath liquid and the dyeing process employing said novel dye bath liquid.

It will be appreciated by those skilled in the art that a variety of additives may be present in the aqueous dye bath liquid apart from the dye itself and the water with which it is associated in the dye bath liquid. Such additives include dye assistants, carriers, promoters, and the like and may be employed in conventional amounts for their usual purposes in the practice of the present invention. The dye itself may be incorporated in the dye bath liquid in amounts generally up to about 5% or more by weight based on the total weight of the dye bath. For heavier or darker shades, the dye may be employed in amounts typically of from about 2% to about 5% by weight, most typically about 3–4% by weight, whereas light shades may be achieved by employing dye concentrations of about one-half % by weight, or less. Dye concentrations outside such ranges can also be employed within the scope of the invention, however, it also being understood that the amount of said dye bath liquid with which the textile material is impregnated, by padding, spraying, coating, printing or other means, commonly at 25–100% wet pickup, will depend upon the color requirements of any given application.

In the conventional drying operation following the impregnating of the textile material with the desired dye, the treated material is heated to any temperature and for any time sufficient to dry off the dye bath liquor, preferably at a temperature of about 100°C. for convenience of rapid action, by any suitable means, such as by hot air, infra-red radiation, microwave oven or the like. Thus, pressures may range from below to above atmospheric, and temperatures below room temperatures to over 100°C. It is during this conventional drying operation that dye migration to the material surface is known to occur, said migration tending to be uncontrolled, random and uneven, thus resulting in an uneven overall dyeing action, stripiness and a generally inferior quality of the finished product.

The antimigration additive incorporated in the aqueous dye bath liquid in the practice of the present invention serves to effectively and efficiently minimize uncontrolled dye migration during the drying operation prior to fixation. The subject additive, heretofore known and available in the art for other purposes, is the amine salt of poly(vinyl methyl ether/maleic acid) believed to have the unit structural formula:

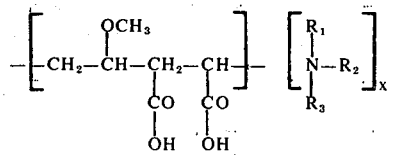

where x is from about 0.5 to about 2.0, preferably from about 1.0 to about 1.25, $R_1$, $R_2$ and $R_3$ each being taken from the group consisting of H, $CH_3$, $CH_2CH_3$, $CH(CH_3)_2$, $CH_2CH_2CH_3$, $CH_2CH_2OH$ and $CH_2CHOHCH_3$, with the exception that $R_1$, $R_2$ and $R_3$ are not all H and that $R_1$ and $R_2$ together may be a divalent unit taken from the group consisting of $-(CH_2)_{\overline{4-6}}$ and $(-CH_2CH_2)_2O$. The parent poly(vinyl methyl ether/maleic anhydride) from which the said poly(vinyl methyl ether/maleic acid) is prepared by hydrolysis has a specific viscosity of from about 0.75 to about 4.5, preferably about 1.0 to 4.0, more preferably about 2.0 to 4.0, measured at a concentration of 1 gram per 100 ml. of methylethyl ketone at 25°C. Illustrative of the amines that can be used in making the subject additive are trimethyl amine and monoethanol amine and the like.

The subject antimigration additive will generally be incorporated in the aqueous dye bath liquid in an amount within the range of from about 0.05% to about 0.50% by weight, based on the total weight of the dye bath liquid, with the additive concentration being commonly in the range of from about 0.10% to about 0.25% by weight. As indicated above, said additives are generally known in the art and available from GAF Corporation, the additives not having been previously employed or considered with respect to the dye migration problem discussed herein. With regard to the additive materials per se, their preparation and prior applications, reference is herein made to U.S. Pat. Nos. 1,976,679, Re. 23,514, and 2,746,837. As the additives employed in the practice of the invention and their production are known and available in the art, detailed information concerning the preparation of the additive compounds is not deemed necessary herein, the present invention being directed to the dye bath liquids and methods of dyeing herein disclosed and claimed in which such known compounds are employed for antimigration purposes.

It should be noted that the pH of the aqueous dye bath liquid of the invention can generally vary over rather broad limits, although it will be appreciated that optimum pH limits will pertain with respect to particular dye bath-textile systems. If the dye bath liquid is too basic in nature, however, the amines may tend to be driven off. For this reason, the pH of the dye bath will generally be less than about 9, e.g., in the range of from about 4 to about 9, typically from about 6 to about 8, preferably about 7, although some dyetextile applications may be operative outside the indicated limits.

After the textile material being treated has been impregnated with a desired dye by contact with the aqueous dye bath liquid of the present invention, and the material has been dried by conventional means, the dye is fixed by heat or other means as by chemical action. Such fixation techniques are well known and established in the textile dyeing art. The present invention is not limited to any such technique, but can be practiced with dye fixation by any conventional technique following the drying of the dye-impregnated fiber. Illustratively, curing may be carried out at temperatures ranging from about 120° to 230°C. for about 3 minutes to 15 seconds, depending on the fabric, the dye, and the like.

The present invention is hereinafter illustrated by reference to specific illustrative examples, it being understood that such examples are presented to provide a further understanding as to the advantages of the invention and should not be construed as limiting the scope thereof as set forth in the appended claims. It will also be understood that all parts and percentages expressed in the examples are by weight unless otherwise so indicated.

EXAMPLE 1

A representative sample of aqueous dye bath liquid was prepared by slurrying 175 g. of poly(vinyl methyl ether/maleic anhydride), specific viscosity 3.77, in 1575 g. of distilled water. Upon heating of the slurry to about 80°–90°C. with a boiling water jacket, a slight exotherm occurred, and the solution cleared, said solution thereafter being allowed to cool having the indicated polymer present therein in the poly(vinyl methyl ether/maleic acid) form. 154 g. of this solution, 26.8 g. of a 25% by weight solution of trimethylamine in water, and 39.2 g. of distilled water were mixed until a homogeneous result was obtained. The resulting additive solution, when measured as a 6% by weight solution in water, had a pH of 7.3.

The additive solution was then incorporated in a dye bath liquid having the following composition: Indanthrene olive T3R paste, GAF Vat Black 25, Color Index No. 69525, 3.0 g.; the additive solution prepared above, 3.0 g.; Gaftex CD 169, a biodegradable anionic surfactant, wetting agent, 0.15 g.; and water, 93.85 g. After the above ingredients were mixed, the pH of the resulting aqueous dye bath liquid was adjusted to 6.7 by the addition of a few drops of glacial acetic acid.

For purposes of illustrative dyeing tests, a 5 inches × 5 inches swatch of 100% cotton twill was padded with the indicated dye bath at 57% wet pickup by weight, based on the weight of dry fabric. The thus-treated material was placed flat on a glass plate and dried by means of an electric hot air gun held with the muzzle 11 inches above the dye-impregnated swatch for 5 minutes. In this manner, the unevenness of drying that occurs in ordinary commercial operations was exaggerated and emphasized in order to illustrate the advantageous effect achieved in the practice of the invention. The reflectance of the two sides of the swatch was measured, after such drying and conventional fixation, with a Hunterlab Spectrometer calibrated to read 100% reflectance for an untreated swatch of cotton twill, increasing lower percentages thus indicating an increased color effect resulting from an increased dye content at the surface of the material. The reflectances thus obtained for the swatch thus dyed in accordance with the invention were 49.1% at the top of the swatch and 59.0% at the bottom, the lower reflectance at the top resulting from the tendency for dye migration to occur during drying and the predetermined positioning of the drying means on top of the swatch as indicated above.

A second swatch sample was treated identically as above except that distilled water was substituted for the additive solution. Under the same drying conditions, the reflectances obtained on top of the swatch and on the bottom thereof were 48.3% and 64.5% respectively. The considerably larger variation in top and bottom reflectance values obtained in the latter test, as compared with that carried out in accordance with the present invention, is indicative of the uneven dyeing that results from uncontrolled and uneven dye migration that inevitably occurs in ordinary commercial dyeing operations of the type herein discussed.

EXAMPLE 2

The procedures set forth in Example 1 were essentially followed in the preparation and use of an additive solution made from 50 g. of the indicated poly(vinyl methyl ether/maleic acid), 3.87 g. of monoethanolamine and 46.13 g. of water. A 9% by weight solution of this additive solution in distilled water gave a pH of 7.1. A dye bath liquid was prepared with this additive solution, said dye bath having the following composition: 3.0 g. of said Indanthrene olive T3R paste; 0.15 g. of said Gaftex CD 169 wetting agent; 4.5 g. of said additive solution; and 92.35 g. of water. After mixing, the pH was adjusted to 6.7 with glacial acetic acid.

Upon treatment of a swatch with this dye bath liquid, drying and fixing said dye, as in Example 1 above, the reflectance values obtained were 52.8% at the top of the swatch and 61.5% at the bottom. An identically treated swatch with the exception that distilled water was again substituted in place of the additive solution gave the following comparative reflectances: 51.5% at the top and 66.5% at the bottom. As in Example 1, the significant reduction in the reflectance variation between the top and bottom of the treated swatch under the predetermined uneven drying conditions employed is indicative of the control of dye migration the present invention makes possible, the minimizing of uncontrolled dye migration and the resulting enhancing of the uniformity and general quality of textile products dyed in accordance with the present invention.

In dyeing operations employing a commonly used textile gum antimigrant, i.e., Superclear 100-N, the effective antimigration action of the present invention has been found to require, on a weight to weight basis, approximately twice the active solid antimigrant content as that required in the practice of the present invention. Coupled with a considerably lower unit cost, for example on the order of about one-third the cost per unit of antimigrant solids, the aqueous dye bath liquid of the present invention permits the production of improved textile products, having enhanced uniformity of color, at a very significantly reduced cost compared with that required with the use of conventional textile gums. The present invention satisfies the needs and requirements of the dyeing art, therefore, in a manner highly advantageous from an overall technical and economic viewpoint.

As indicated above, commercially applicable techniques for the drying of dye-impregnated textile materials are always subject to variations and degrees of unevenness that tend to result in uncontrolled, random and uneven migration of the dye to the surface of the treated material. Even under highly uneven drying conditions, beyond those likely to be encountered in quality commercial applications, the present invention tends to minimize such uncontrolled and uneven dyeing migration. As a result, textile material dyed in accordance with the practice of the present invention has an enhanced evenness and quality of color, avoiding the unevenness and stripiness that obtains in inferior dyeing operations and products. As the highly desirable results obtainable by means of the present invention are accomplished in an advantageously economic manner, with desired flexibility of application, the invention herein described and claimed represents an important advance in the textile dyeing art, and the production of premium quality textile products.

Therefore, We claim:

1. In an aqueous dye bath liquid suitable for the impregnating of textile material with said dye, with subsequent drying prior to the fixing of said dye, the improvement comprising the incorporation in said dye bath of a polymeric antimigration additive in an amount within the range of from about 0.05% to about 0.50% by weight, based on the total weight of said dye bath, said additive being the amine salt of poly(vinyl methyl ether/maleic acid) having the unit structural formula:

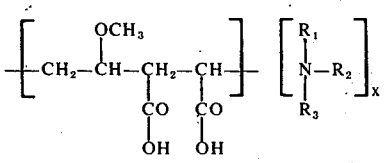

where $x$ is from 0.5 to 2.0, $R_1$, $R_2$ and $R_3$ each being taken from the group consisting of H, $CH_3$, $CH_2CH_3$, $CH(CH_3)_2$, $CH_2CH_2CH_3$, $CH_2CH_2OH$ and $CH_2CHOHCH_3$, with the exception that $R_1$, $R_2$ and $R_3$ are not all H and that $R_1$ and $R_2$ together may be a divalent unit taken from the group consisting of $-(CH_2)_{\overline{4-6}}$ and $(-CH_2CH_2)_2O$, the presence of said additive serving to minimize uncontrolled dye migration to the surface of the dye-impregnated textile material during the drying of said material prior to fixing, thus enhancing the uniformity of the dyeing operation and the color properties of the dyed textile material.

2. The aqueous dye bath liquid of claim 1 in which $x$ is from 1.0 to 1.25.

3. The aqueous dye bath liquid of claim 1 in which said additive is present in an amount within the range of from about 0.10% to about 0.25% by weight based on the total weight of said dye bath.

4. The aqueous dye bath liquid of claim 1 in which said amine is trimethyl amine.

5. The aqueous dye bath liquid of claim 1 in which said amine is monoethanolamine.

6. A process for the dyeing of textile materials essentially without uncontrolled migration of the dye to the surface of the material during the drying of the impregnated material prior to dye fixation, consisting essentially of:

a. impregnating the textile material being treated with an improved aqueous dye bath liquid as defined in claim 1;

b. heating said dye-impregnated textile material to remove aqueous dye bath liquid therefrom, thus drying said material; and c. fixing said dye present in said dried, dye-impregnated textile material, whereby the antimigration additive serves to minimize uncontrolled dye migration to the surface of the textile material during said drying operation, thus enhancing the uniformity of the dyeing operation and the color properties of the dyed textile material.

7. The process of claim 6 in which $x$ is from 1.0 to 1.25.

8. The process of claim 6 in which said additive is present in an amount within the range of from about 0.10% to about 0.25% by weight based on the total weight of said dye bath.

9. The process of claim 6 in which said amine is trimethyl amine.

10. The process of claim 6 in which said amine is monoethanolamine.

11. The process of claim 6 in which said textile material being treated is taken from the group consisting of cotton, polyester and cotton-polyester blend fabrics.

* * * * *